US008850786B2

(12) United States Patent
Tung et al.

(10) Patent No.: US 8,850,786 B2
(45) Date of Patent: Oct. 7, 2014

(54) SYSTEMS AND METHODS FOR INTERMITTENTLY COLORED YARN

(75) Inventors: Wae-Hai Tung, Marietta, GA (US); Subhash Chand, Elgin, SC (US); John Paul Ryan, Newark, DE (US)

(73) Assignee: INVISTA North America S.à.r.l., Wilmington, DE (US)

( * ) Notice: Subject to any disclaimer, the term of this patent is extended or adjusted under 35 U.S.C. 154(b) by 176 days.

(21) Appl. No.: 13/320,772

(22) PCT Filed: Jun. 4, 2010

(86) PCT No.: PCT/US2010/037461

§ 371 (c)(1), (2), (4) Date: Feb. 1, 2012

(87) PCT Pub. No.: WO2010/141856

PCT Pub. Date: Dec. 9, 2010

(65) Prior Publication Data

US 2012/0131896 A1 May 31, 2012

Related U.S. Application Data

(60) Provisional application No. 61/184,434, filed on Jun. 5, 2009.

(51) Int. Cl.
*D06B 11/00* (2006.01)
*D02G 1/12* (2006.01)

(52) U.S. Cl.
CPC ..... *D06B 11/0006* (2013.01); *D02G 1/122* (2013.01); *D06B 11/0023* (2013.01)
USPC ..... 57/258; 57/246; 57/292; 57/296

(58) Field of Classification Search
USPC ..... 57/246, 250, 258, 292, 296
See application file for complete search history.

(56) References Cited

U.S. PATENT DOCUMENTS

| | | | | |
|---|---|---|---|---|
| 3,135,039 | A | 6/1964 | Mattson | |
| 3,525,134 | A | 8/1970 | Coon | |
| 3,644,969 | A | 2/1972 | Guillermin et al. | |
| 3,751,778 | A | 8/1973 | Vidal et al. | |
| 3,827,113 | A * | 8/1974 | Vidal et al. | 28/255 |
| 3,899,903 | A * | 8/1975 | Lapierre | 68/205 R |
| 4,068,502 | A | 1/1978 | Anderson | |
| 4,177,037 | A | 12/1979 | Anderson | |

(Continued)

FOREIGN PATENT DOCUMENTS

| | | |
|---|---|---|
| JP | 07090768 | 4/1995 |
| JP | 11140768 | 5/1999 |
| KR | 19930005518 | 8/1993 |
| KR | 20030076751 | 9/2003 |

*Primary Examiner* — Shaun R Hurley
(74) *Attorney, Agent, or Firm* — Joseph N. Moonjely

(57) ABSTRACT

Intermittently colored yarns having an intermittent and random dye spacing pattern, and systems and methods of making the same, are disclosed. Such intermittently colored yarns exhibit higher quality and lower manufacturing costs over the known intermittently colored yarns. The intermittent coloring takes place while the yarn is in caterpillar form. Carpets made from such intermittently colored yarns exhibit enhanced aesthetics over carpets made from known intermittently colored yarns. Alternatively, a stain resist, colorless base dye, or bleaching agent can be applied in the same intermittent and random spacing pattern to the intermittently colored yarns prior to subsequent dyeing. This creates a mirror image like color effect to the resulting yarn.

37 Claims, 3 Drawing Sheets

(56) References Cited

U.S. PATENT DOCUMENTS

| | | | | | |
|---|---|---|---|---|---|
| 4,315,355 | A | | 2/1982 | Stanley | |
| 4,361,019 | A | * | 11/1982 | Maund | 68/62 |
| 4,505,013 | A | * | 3/1985 | Nelson | 28/274 |
| 4,742,699 | A | | 5/1988 | Nakahara et al. | |
| 4,894,894 | A | | 1/1990 | Coons, III et al. | |
| 5,794,427 | A | | 8/1998 | Cavedon et al. | |
| 5,983,470 | A | | 11/1999 | Goineau | |
| 6,019,799 | A | * | 2/2000 | Brown et al. | 8/483 |
| 6,085,395 | A | * | 7/2000 | Weiss | 28/221 |
| 6,085,396 | A | | 7/2000 | Huang | |
| 6,119,320 | A | | 9/2000 | Weiss | |
| 6,814,828 | B1 | | 11/2004 | Huebner | |
| 7,284,306 | B2 | * | 10/2007 | Hoover | 28/220 |

* cited by examiner

SYSTEMS AND METHODS FOR INTERMITTENTLY COLORED YARN

This application claims benefit of priority from U.S. Provisional Application No. 61/184434 filed Jun. 5, 2009.

FIELD OF THE INVENTION

The invention relates to the textile industry, and specifically intermittently colored yarns for use in carpets and fabrics. Processes for making the intermittently colored yarns are also disclosed. The yarns are intermittently colored while in caterpillar form, which results in a random, intermittent dye pattern.

BACKGROUND

It is common to dye yarns that are used in various goods, such as carpeting. In some instances, yarns having intermittent colored segments are desired in the production of such goods.

A known method for intermittently coloring yarn comprises knitting non-dyed yarn into tubing, applying multiple dyes (e.g., using a printing process) on the tubing, steaming to cure the dyes, washing to remove excess dyes, and de-knitting the tubing to form the final intermittently colored yarn. This process is very tedious and expensive, so much so that it severely restricts penetration of intermittently colored yarn into the market.

Another somewhat lower cost process of making intermittently colored yarn comprises a continuous dyeing process in which 36-48 ends of non-dyed yarn are processed together as warp. Multiple dyes are sprayed on the warp followed by subsequent steaming, washing, and drying, with subsequent winding to form 36-48 individual yarn packages. This process primarily works with high interlace, low crimp bulked continuous filament (BCF) yarns. It does not work well with most of the regular BCF yarns with normal crimp and interlace levels due to frequent entanglement which tends to occur with such yarns during the winding process as neighboring ends tend to stick together due to the presence of crimp. Carpets made from yarns with such high interlace and low crimp as required for the known spray dyeing processes are perceived to be of lower quality, and do not participate in premium offerings.

Even earlier examples of the background art include a variety of devices where yarn is compressed or tightly crimped and dye is applied via jets or tapes in tightly confined spaces. These processes, as disclosed in U.S. Pat. Nos. 3,135,039, 3,644,969, 3,751,778, 4,068,502, 4,177,037, and 4,742,699, share two common shortcomings. They provide poor productivity due to slow operating speeds, and they are not able to accurately reproduce an intermittent color appearance owing to excessive, unintended dye transfer to the yarn by the surfaces of the confining spaces into which dye is applied.

SUMMARY OF THE INVENTION

Cost effective intermittently colored yarns are becoming increasingly desirable in the textile industry as consumers demand an ever expanding array of color choices and patterns.

Up to this point, carpets and fabrics made from intermittently colored yarns have been of low quality or high cost, thereby not achieving wide spread market penetration.

Therefore, it would be desirable to be able to produce intermittently colored yarn with high crimp and moderately low interlace without having to incur as much time and/or expense as required by processes of the background art.

In one aspect, a method of making a dyed synthetic yarn is disclosed comprising extruding synthetic polymer into filaments; quenching said filaments in air; bringing the filaments together to form a yarn; bulk texturing said yarn; impinging said yarn into a screen or plate to achieve a caterpillar form; and applying a dye to the yarn while the yarn is in caterpillar form. The dye can be applied while the caterpillar yarn rests on the surface of a rotating drum or moving belt.

In another aspect, a method of spinning yarn is disclosed comprising extruding filaments; combining the filaments to form a multi-filament yarn; drawing the yarn; bringing the yarn to an elevated temperature; ejecting the yarn from a bulking jet at an elevated temperature; impinging the yarn to form a yarn caterpillar; applying dye to the yarn caterpillar; and cooling the dyed yarn caterpillar. The dye can be applied while the yarn caterpillar rests on a bulking drum or moving belt.

In a further aspect, a system for spinning yarn is disclosed, comprising a bulking jet configured to eject yarn at an elevated temperature and a high velocity (or alternatively a bulking jet configured to eject a yarn plug); a bulking device having an outer surface, the bulking device being configured to receive the ejected yarn (or alternatively the yarn plug) and abruptly impede its travel so that the yarn bunches on the outer surface and forms a yarn caterpillar; and a spray nozzle positioned adjacent the bulking device outer surface. The bulking device can be a rotating drum or moving belt. Further the spray nozzle can spray acid dyes, stain resist, colorless base dyes or bleaching agents.

In yet another aspect, an intermittently colored yarn is disclosed, comprising a length and intermittent colored segments positioned along the length, the intermitted colored segments having been formed by applying dye to the yarn while the yarn is bunched in a caterpillar form during the yarn bulking process. The intermittently colored yarn can be manufactured into carpet.

In yet a further aspect, a method of making a mirror imaged dyed synthetic yarn is disclosed comprising extruding synthetic polymer into filaments; quenching said filaments in air; bringing the filaments together to form a yarn; bulk texturing said yarn; impinging said yarn into caterpillar form; applying a dye preventing agent selected from the group consisting of stain resists, colorless base dyes and bleaching agents to the yarn while the yarn is in caterpillar form; and optionally subsequently dyeing the yarn. The dye preventing agent selected from the group consisting of stain resists, colorless base dyes and bleaching agents can be applied while the caterpillar yarn rests on the surface of a rotating drum or moving belt. Further, subsequent dyeing can take place immediately after the dye preventing agent is applied while the yarn is in caterpillar form, or can be applied after the yarn is drawn out of caterpillar form.

BRIEF DESCRIPTION OF THE FIGURES

The disclosed systems and methods can be better understood with reference to the following drawings. The components in the drawings are not necessarily to scale.

DETAILED DESCRIPTION

Figure 1:
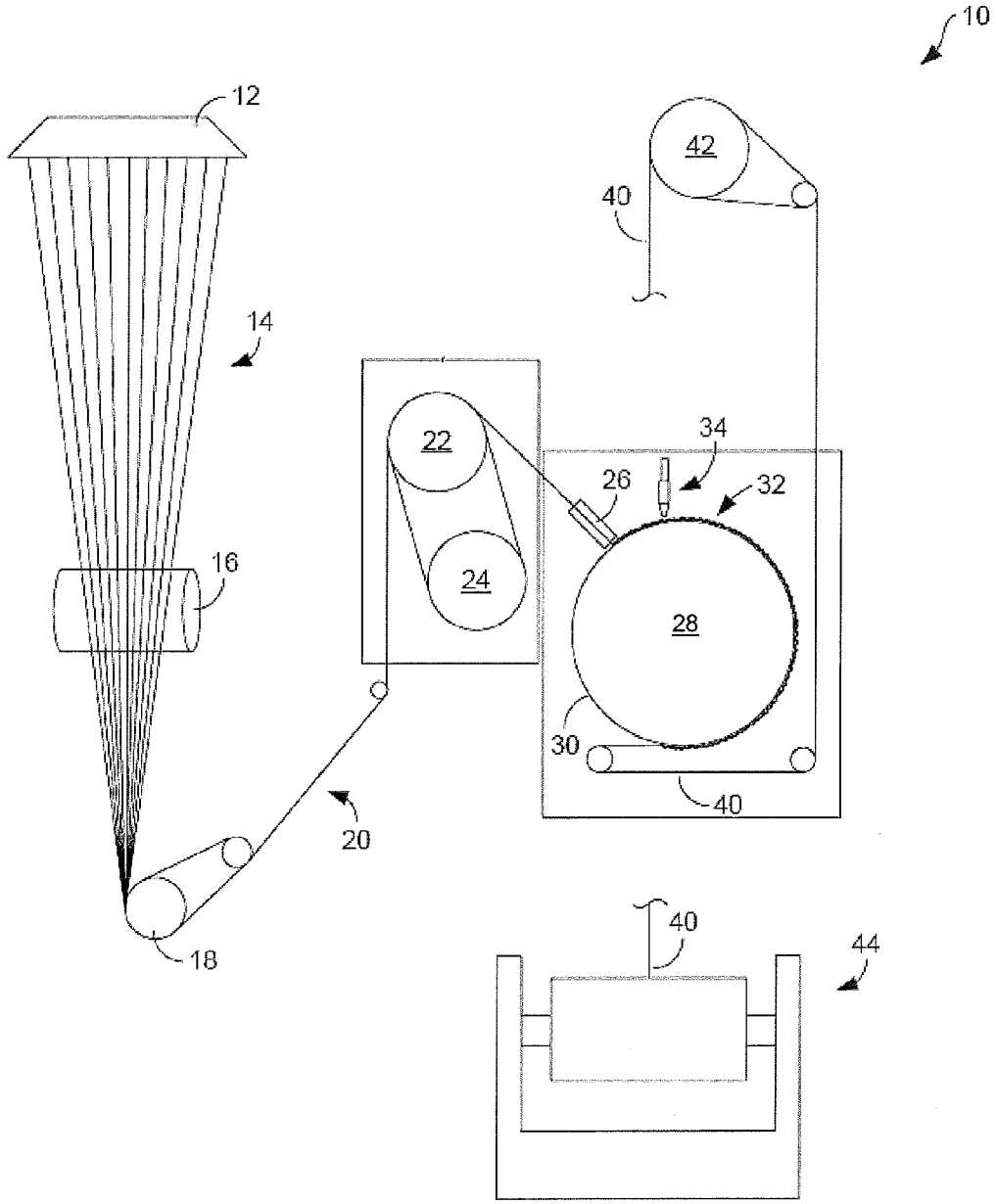
FIG. 1 is a block diagram of one aspect of a system for intermittently coloring yarn using a rotating drum.

As described above, it would be desirable to be able to produce intermittently colored yarn or yarns having unique aesthetics or having similar aesthetics to space dyed prior art yarns in less time and/or more economically than currently possible through use of known methods. Disclosed herein are systems and methods for intermittent coloring with which yarn can be quickly and cost effectively dyed to create a novel and useful aesthetic similar to, but generally distinguishable from, intermittently colored yarns of the prior art. Using those systems and methods, yarn is effectively dyed during fabrication, i.e., as part of the yarn spinning process.

The yarn can be dyed immediately after a yarn bulking process is performed. In one aspect, a synthetic yarn dyeing method comprises ejecting the yarn from a bulking jet onto a rotating drum so that the yarn bunches on the drum surface and takes on a "caterpillar" form. Dye can then be applied to the bulked yarn while in its caterpillar form, for instance using one or more nozzles adjacent the drum and the air jet. Because the yarn is bunched into the caterpillar form during the application of dye, the yarn will have intermittent colored segments once it is drawn straight again, the pattern of which is generally similar to but distinguishable from the intermittently colored yarns of the prior art by the small dimensions and relatively irregular spacing of the dye pattern on the yarn and in the carpets and fabrics subsequently made from such yarn. Alternatively, the bulking process comprises ejecting the yarn from a bulking jet onto a moving belt, so that the yarn bunches on the belt surface and takes on a "caterpillar" form. The dye can be applied in the same fashion as used with the bulking drum. Further, the dye can be applied in a continuous or intermittent fashion, and multiple spray nozzles and colors can be used, depending on the desired color pattern. A vacuum can also be applied inside the rotating drum or moving belt to assist with the penetration of dye into the yarn and/or to cool and dry the yarn.

In another aspect, a mirror image synthetic yarn dyeing method comprises ejecting the yarn from a bulking jet onto a rotating drum so that the yarn bunches on the drum surface and takes on a "caterpillar" form. A stain resist, colorless base dye or bleaching agent can then be applied to the bulked yarn while in its caterpillar form, for instance using one or more nozzles adjacent the drum and the air jet. Because the yarn is bunched into the caterpillar form during such applications, the yarn will have some areas that are resistant to a subsequent dye application while other areas are not. The subsequent dye application can take place immediately after the stain resist/colorless base is applied while the yarn is in caterpillar form, or the yarn can be drawn out of caterpillar form and dyed. The result is a mirror image effect compared to the intermittently colored yarns disclosed above. Alternatively, the bulking process comprises ejecting the yarn from a bulking jet onto a moving belt, so that the yarn bunches on the belt surface and takes on a "caterpillar" form. The stain resist, colorless base dye or bleaching agent can be applied in the same fashion as used with the bulking drum. Further, the stain resist, colorless base dye or bleaching agent can be applied in a continuous or intermittent fashion, and multiple spray nozzles can be used, depending on the desired color pattern. A vacuum can also be applied inside the rotating drum or moving belt to assist with the penetration of stain resist or colorless base dye into the yarn and/or cool the yarn.

Figure 2:
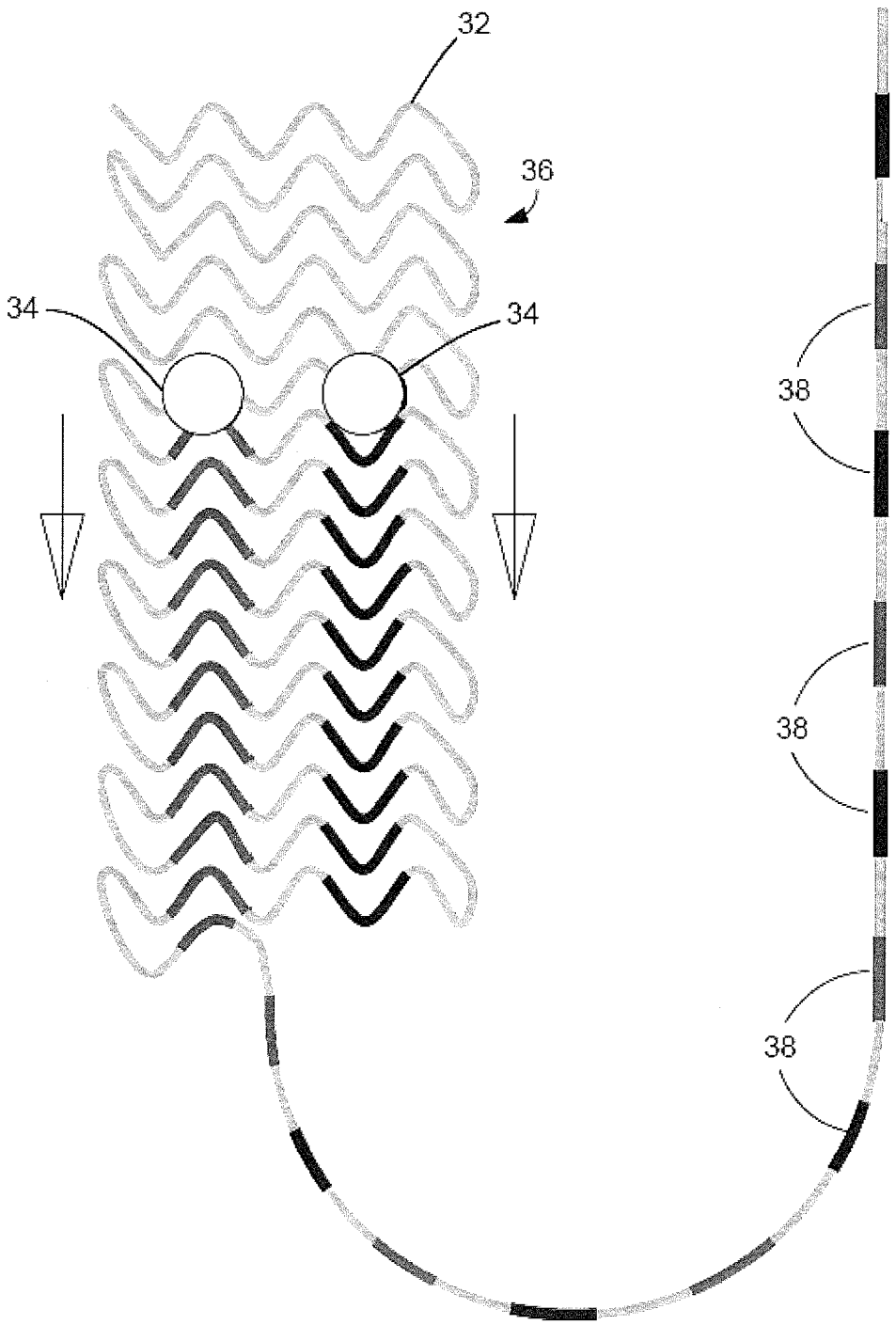
FIG. 2 is a schematic illustration of nozzles of the system of FIG. applying dye to an example yarn to provide the yarn with an intermittently colored appearance.

In a further aspect, a system and method for spinning and intermittently coloring yarn is disclosed. Such a system 10 is illustrated in FIGS. 1 and 2.

Here, a polymer (e.g., nylon 6,6 or nylon 6) or a mixture of polymers is extruded through a spinneret 12 at an elevated temperature, such as approximately 245 to 295° C., to form continuous filaments 14. The filaments 14 are cooled through immersion within a suitable fluid. The filaments 14 can be passed through a quench chimney (not shown) in which the filaments are cooled by a radial or cross flow of gas, such as humidified air, at a temperature of approximately 5 to 20° C. and at a velocity of approximately 0.2 to 0.8 meters/second (m/s).

The filaments 14 are pulled by a feed roll 18, which may be positioned at a significantly lower physical elevation than the spinneret 12. Prior to reaching the feed roll 18, a lubricating finish can be applied to the filaments, for example using a finish roll 16. The feed roll 18 can be heated to a temperature between the glass transition temperature of the filaments and approximately 200° C. in order to heat the filaments for drawing. Alternatively, however, the feed roll 18 can be at room temperature. Irrespective of whether the feed roll 18 is or is not heated, the feed roll rotates at a relatively low speed. For example, the feed roll 18 can rotate at a speed at which the filaments 14 travel at approximately 500 to 1,500 yards/minute (ypm).

After leaving the feed roll 18 (and in some cases prior to reaching the feed roll), the filaments 14 have been combined to form a continuous filament yarn 20. The yarn 20 is drawn by hot draw rolls 22 and 24, which are contained within an enclosure 26. By way of example, the draw rolls 22 and 24 are heated to a temperature of approximately 150 to 220° C. to heat the yarn and enable yarn bulking. The draw rolls 22 and 24 can rotate several times (e.g., approximately two-three times) the speed of the feed roll 18. By way of example, the draw rolls 22 and 24 can rotate at a speed at which the yarn 20 travels at approximately 800 to 3,500 ypm.

The draw rolls 22 and 24 deliver the yarn 20 to a bulking jet 26, such as that described in U.S. Pat. No. 3,525,134 (the disclosure of which is hereby incorporated by reference), which blows and deforms the filaments 14 of the yarn 20 in multiple directions using a hot bulking fluid, such as air or steam. By way of example, the bulking fluid has a temperature of approximately 180 to 240° C. and a pressure of approximately 80 to 140 pounds/inch$^2$ (psi). Due to the high pressure of the bulking fluid, the yarn 20 is ejected from the bulking jet 26 in a highly crimped form and is caused to impact the surface 30 of an adjacent bulking drum 28. The yarn 20 therefore impinges upon the drum surface 30 in a way that folds and compresses the yarn, maintains the yarn filament crimps provided by the bulking jet 26 and helps to maintain the texture and bulk of the yarn by allowing it to cool in a relaxed form on the bulking drum. Alternatively, a stuffer jet type bulking jet can be used to form a yarn plug within the stuffer jet, and the plug of yarn can be advanced onto a cooling drum, either by friction with the cooling drum or by other means such as nip rolls, to form a yarn caterpillar on the rotating cooling drum. Because the bulking or cooling drum 28 rotates at a relatively slow speed (e.g., 15 to 60 revolutions/minute (rpm)), the yarn 20 tends to remain in a bunched up form on the drum surface 30 such that it generally resembles a caterpillar as it extends from the exit of the bulking jet. For that reason the bulked continuous filament (BCF) yarn 32 on the surface 30 of the drum 28 is occasionally referred to as being in a "caterpillar" form. The surface 30 of the bulking drum 28 can be perforated (e.g., is formed as a screen or perforated plate) such that air can be drawn into the drum and evacuated therefrom to cool the BCF yarn 32 and set the newly formed texture and bulk. Alternatively, a moving belt can replace the bulking drum 28.

Intermittent coloring of the instant disclosure can be performed on the BCF yarn 32 while it is still in caterpillar form on the surface 30 of the bulking drum 28. For example, intermittent coloring is performed immediately after the drawn and bulked yarn (i.e., the yarn downstream of the draw rolls 22 and 24 and upstream of the bulking drum 28) impinges the bulking drum, while the BCF yarn is still at an elevated temperature (e.g., approximately 80 to 200° C.). To that end, one or more dye spray nozzles 34 are positioned adjacent both the drum surface 30 and the bulking jet 26 that are capable of continuously or intermittently spraying dye. Because the BCF yarn 32 is in its caterpillar form at the point at which the spray nozzle or nozzles 34 apply the dye, the yarn will comprise intermittent colored segments.

The intermittent colored segments are shown in FIG. 2. FIG. 2 is a schematic plan view of the BCF yarn caterpillar 36 as it rests on the surface 30 of the bulking drum 28 (which rotates in the direction of the down arrows). Although the caterpillar 36 is depicted as being arranged (i.e., bunched) in a repeating pattern, such a pattern is shown merely for purposes of simplicity and discussion. In most cases, the BCF yarn 32 will have a random pattern after it impinges upon the drum surface 30.

In the example provided, two dye nozzles 34 are positioned above the caterpillar 36 that spray different colored dyes onto the caterpillar. As can be appreciated from FIG. 2, as dye is sprayed on the caterpillar 36 by the nozzles 34, even when the dyes are sprayed continuously, dye is applied to and penetrates only discrete segments of the length of the BCF yarn 32. As a consequence, the BCF yarn 32 as it is drawn from the bulking drum 28 has intermittent color segments 38 along its length. The dye can also be applied in a continuous manner or intermittent manner, depending on the color pattern desired.

The dye applied to the caterpillar 36 can be low-pH (e.g., pH less than 5) dye, which sets relatively quickly, including dyes having a pH from about pH 3 to about pH 5. Example dyes include acid dyes, reactive dyes, and pre-metalized dyes. The dye solution is heated to approximately 25° C. to 100° C., including about 50° C. to 100° C. Notably, the relatively slow speed of the bulking drum 28 facilitates absorption and setting of the dyes. Alternatively, a stain resist or colorless base dye can replace the dyes in the above disclosed system. When a stain resist or colorless base dye is used, a mirror image color pattern can be achieved because the areas treated with the stain resist or colorless base dye will not absorb any dye applied subsequently. Subsequent dye can be applied using the above disclosed method while the yarn is in caterpillar form, or can be applied after the yarn is drawn out of caterpillar form.

Returning to FIG. 1, the now intermittently colored BCF yarn 40 is drawn from the bulking drum 28 using a take up roll 42. By way of example, the take up roll rotates at a speed at which the yarn travels, typically at approximately 500 to 3,000 ypm, with higher speeds readily practicable. The intermittently colored BCF yarn 40 is then wound onto a roll by a winder 44, which may rotate at approximately the same speed as the take up roll 42. The dyes can be completely set through a subsequent heat set process, such as a Superba process.

As can be appreciated from the foregoing disclosure, intermittently colored yarn can be produced by dyeing the yarn during the spinning process. Such dyeing can be performed without altering the spinning process, with the exception of spraying dye on the caterpillar. Therefore, spinning can be performed at the same speeds that would be used even if the yarns were not intermittently colored. Accordingly, no additional time is needed to obtain the intermittently colored aesthetic. Moreover, because the dyeing process is integrated into the spinning process, no expensive off-line processes such as dyeing, steaming, rinsing, and drying are required, thereby reducing production costs.

The disclosed processes can result in a natural frequency of continuous colored segments that can be varied throughout the yarn length. The length of the dyed segments can be between about 0.1 cm to about 3 cm, including about 0.1 cm to about 2 cm, about 0.1 cm to about 1 cm, about 0.5 cm to about 1 cm, about 0.5 cm to about 2 cm, about 0.5 cm to about 3 cm, about 1 cm to about 2 cm, and about 1 cm to about 3 cm. The spacing between the dyed segments (i.e. non-dyed segments) can be the same length as the dyed segments or larger. The dye spacing also tends to be irregular as a result of the natural randomness of the yarn orientation within the caterpillar in a way that is not reproducible with known prior art techniques. Further, the dye can penetrate the entire diameter of the yarn or just a portion of the diameter, including between about 10% to 90% of the yarn diameter, about 30% to about 90%, about 50% to about 90%, about 70% to about 90%, about 10% to about 50%, about 30% to about 80%, and about 30% to about 70%. The variability in dye penetration depth results in a variation of dye depth and intensity which is not reproducible using known prior art techniques.

Figure 3A:
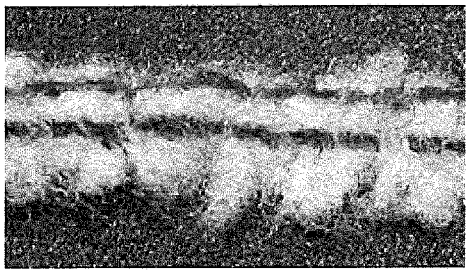
FIGS. 3*a*, 3*b*, and 3*c* are pictorial representations of one aspect of an intermittently colored yarn, dyed using one aspect of the disclosed methods.
Figure 3B:
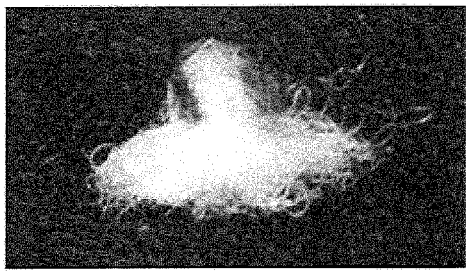
Figure 3C:
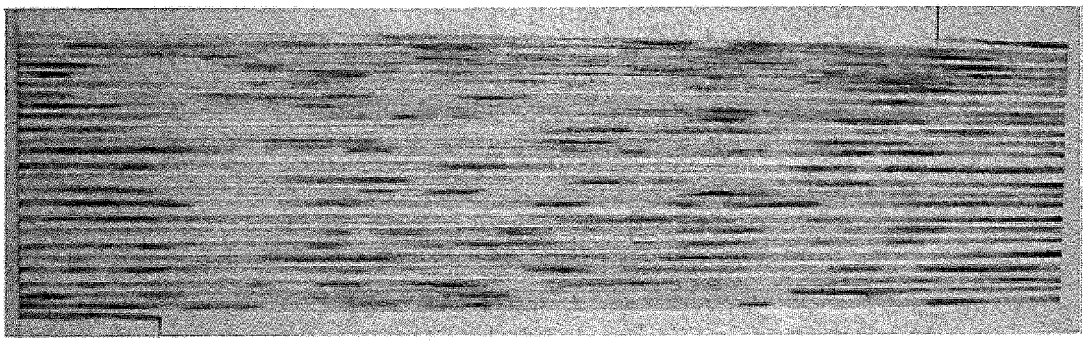

FIG. 3 highlights the above dyed segment spacing and dye fading appearance disclosed above. FIG. 3*a* shows the yarn caterpillar after being dyed with red and black dyes, but prior to being removed from caterpillar form. FIG. 3*b* shows a cross-sectional view of the yarn caterpillar after being dyed. Here, the depth of dye penetration can be seen. FIG. 3*c* shows the same yarn wound on a cardboard plate. Here, the variability in the color segment length, the spacing between color segments, and the variability in dye penetration (i.e. fading) are readily apparent.

Surprisingly, by injecting dye directly onto the caterpillar in an unconfined space, with vacuum drawn through the caterpillar face, there is essentially zero transfer of dye either through or around the caterpillar onto the drum surface. As a result, unintended dye transfer is avoided and the spacing of dye application is easily controlled.

EXAMPLES

Example 1

The polymer used for this example was a medium acid white dyeable Nylon 66 polymer having 42 milliequivalents of amine ends per 1000 grams, a viscosity of 67 RV and containing 0.15% $TiO_2$. The polymer temperature before the spinning pack was controlled to be about 286+/−1° C., and the spinning throughput was 76 pounds per hour. The polymer was extruded through a spinneret and divided into two 100 filament segments. The molten fibers were then rapidly quenched in a chimney where cooling air at approximately 10° C. was blown past the filaments at 300 cubic feet/minute (fpm) through the quench zone, and the fibers then were coated with a lubricant for drawing and crimping. The coated yarns were drawn at approximately 2,400 ypm (2.2×draw ratio) using a pair of heated (195° C.) draw rolls. The yarns were then forwarded into a dual-impingement bulking jet (225° C., 125 psi hot air). The bulking jet crimped and laid the yarn bundles on a rotating drum (45 rpm) with perforated holes to form two moving caterpillars.

Two 0.20 millimeter (mm) diameter nozzles were installed above each caterpillar. Positive displacement pumps were used to pump and spray liquid dye solutions through the nozzles and onto the moving caterpillars. Dye solutions were heated to approximately 90° C. prior to addition on to caterpillars. For this example, two dye solutions were used. The first solution had a black color and was created by mixing 4% Lanacron Black N-BGL (by Huntsman International, LLC) in pH 2 water. The second solution had a rust color and was created by mixing 8% Lanacron dyes (95% Lanacron Yellow N-2GL KWL and 5% Lanacron Red N-B KWL) in pH 2 water. The amount of dye solution sprayed on caterpillars in terms of solid dye weight on yarn was 0.25% black and 0.5% rust color.

The caterpillars were about 1 centimeter (cm) wide and 0.6 cm in height. Only a small portion of the caterpillar received dye solution. After color addition, the caterpillars were forwarded with the rotation drum for approximately 400 milliseconds (ms), taken out by a take up roll at 2,200 ypm, and wound on a winder to form two 1,200 denier, 10 denier/filament (dpf) BCF yarn with intermittent black and rust color. The spacing between segments of the same color was about 2 to 10 cm and the length of each color segment was about 0.15 to 2 cm.

Example 2

This example was similar to Example 1, except a steam chamber was installed above the caterpillar. Pressurized steam (35 psi, 260° C.) was blown onto the caterpillar to improve color fixing. Residence time of the BCF yarn inside steam chamber was approximately 160 ms.

Example 3

This example was similar to example 2 except the flow of dye solutions were cut to half: 0.13% black dye solution on yarn and 0.25% rust dye solution on yarn.

Example 4 (Comparative)

This example was produced similar to Example 1 except no dye solution was sprayed on the caterpillar. The caterpillar comprised a typical white nylon BCF yarn.

Example 5

One end of Example 1 yarn was combined with one end of Example 4 yarn on a Volkman twisting machine at 6,500 rpm to form 6.25 twist per inch cable twisted yarn, which was subsequently heat set on a Superba heat setting machine at 130° C.

Example 6

One end of Example 2 yarn was combined with one end of Example 4 yarn on a Volkman twisting machine at 6,500 rpm to form 6.25 twist per inch cable twisted yarn, which was subsequently heat set on a Superba heat setting machine at 130° C.

Example 7

One end of Example 3 yarn was combined with one end of Example 4 yarn on a Volkman twisting machine at 6,500 rpm to form 6.25 twist per inch cable twisted yarn, which was subsequently heat set on a Superba heat setting machine at 130° C.

Example 8

One end of Example 4 yarn was combined with another end of Example 4 yarn on a Volkman twisting machine at 6,500 rpm to form 6.25 twist per inch cable twisted yarn, which was subsequently heat set on a Superba heat setting machine at 130° C.

Example 9

One end of Example 8 yarn was combined with one end of Example 5 yarn on a Volkman twisting machine to form 1.25 twist per inch cable twisted yarn.

Example 10

One end of Example 8 yarn was combined with one end of Example 6 yarn on a Volkman twisting machine to form 1.25 twist per inch cable twisted yarn.

Example 11

One end of Example 8 yarn was combined with one end of Example 7 yarn on a Volkman twisting machine to form 1.25 twist per inch cable twisted yarn.

Examples 12

Example 9, 10, and 11 yarns were tufted into Frieze-style carpet on a 3/16 gauge tufting machine to form 1.5 inch (in.) pile height, 60 ounce/yard$^2$ carpet. The carpet had three equal-width bands of Example 9, 10, and 11 yarns. The carpet was dyed on a continuous range dyer to a wool beige color. The finished carpet had an attractive aesthetic with intermittent black and rust colored segments.

Example 13

This example was similar to Example 12, except a 1 in. pile height, 32 ounce (oz.) Frieze-style carpet was formed. It had attractive aesthetics and excellent value.

While the invention has been described in conjunction with specific embodiments thereof, it is evident that the many alternatives, modifications, and variations will be apparent to those skilled in the art in light of the foregoing description. Accordingly, the invention is intended to embrace all such alternatives, modifications and variations as fall within the spirit and scope of the claims.

Claimed are:

1. A method for making dyed synthetic yarn, the method comprising: extruding synthetic polymer into filaments; quenching said filaments in air; bringing the filaments together to form a yarn; bulk texturing said yarn; impinging said yarn into a screen or plate to achieve a caterpillar form; and applying dye to the yarn while the yarn is in caterpillar form.

2. The method of claim 1, wherein applying dye comprises applying dye to the yarn while it rests in caterpillar form on the surface of a rotating drum.

3. The method of claim 2, further comprising applying a vacuum to the inside of the rotating drum.

4. The method of claim 3, wherein applying dye to the yarn comprises spraying dye on the yarn in caterpillar form with a spray nozzle positioned adjacent the bulking drum surface and a bulking jet.

5. The method of claim 4, wherein spraying dye on the yarn in caterpillar form comprises continuously spraying dye on the caterpillar.

6. The method of claim 4, wherein spraying dye on the yarn in caterpillar form comprises intermittently spraying dye on the caterpillar.

7. The method of claim 4, wherein spraying dye on the yarn in caterpillar from comprises spraying multiple colors of dye on the yarn with multiple spray nozzles.

8. The method of claim 1, wherein applying dye comprises applying a dye with a pH from about pH 3 to about pH 5 to the yarn.

9. The method of claim 1, wherein applying dye comprises applying one or more of an acidic, a reactive, or a pre-metalized dye to the yarn.

10. The method of claim 1, wherein applying dye comprises applying dye to the yarn while it rests in caterpillar form on the surface of a moving belt.

11. A method for spinning yarn, the method comprising:
extruding filaments;
combining the filaments to form a multi-filament yarn;
drawing the yarn;
bringing the yarn to an elevated temperature;
ejecting the yarn from a bulking jet at an elevated temperature;
impinging the yarn to form a yarn caterpillar;
applying dye to the yarn caterpillar; and
cooling the dyed yarn caterpillar.

12. The method of claim 11, wherein the dye is applied while the yarn caterpillar rests on a bulking drum surface.

13. The method of claim 12, wherein the dyed yarn caterpillar is cooled while on the bulking drum surface.

14. The method of claim 11, wherein applying dye to the yarn caterpillar comprises applying dye to the yarn caterpillar while it is at a temperature of approximately 80 to 200° C.

15. The method of claim 12, wherein applying dye to the yarn caterpillar comprises spraying dye on the yarn caterpillar with a spray nozzle positioned adjacent the bulking drum surface and the bulking jet.

16. The method of claim 12, wherein applying dye to the yarn caterpillar comprises spraying multiple colors of dye on the yarn caterpillar with multiple spray nozzle positioned adjacent the bulking drum surface and the bulking jet.

17. The method of claim 11, wherein applying dye to the yarn caterpillar comprises continuously spraying dye on the yarn caterpillar.

18. The method of claim 11, wherein applying dye to the yarn caterpillar comprises intermittently spraying dye on the yarn caterpillar.

19. The method of claim 11, wherein applying dye to the yarn caterpillar comprises applying a dye with a pH from about pH 3 to about pH 5.

20. The method of claim 11, wherein applying dye to the yarn caterpillar comprises applying one or more of an acidic, a reactive, or a pre-metalized dye to the yarn caterpillar.

21. The method of claim 11, wherein the dye is applied while the yarn caterpillar rests on a moving belt surface.

22. A system for spinning yarn, the system comprising:
a bulking jet configured to eject yarn at an elevated temperature and a high velocity;
a bulking device having an outer surface, the bulking device being configured to receive the ejected yarn and abruptly impede its travel so that the yarn bunches on the outer surface and forms a yarn caterpillar; and
a spray nozzle positioned adjacent the bulking device outer surface.

23. A system for spinning yarn, the system comprising:
a bulking jet configured to make a yarn plug,
a bulking device having an outer surface, the bulking device being configured to receive the yarn plug and to form a yarn caterpillar resting on the outer surface of the bulking device; and
a spray nozzle positioned adjacent to the bulking device outer surface.

24. The system of claim 22 or 23, wherein the bulking device is a bulking drum.

25. The system of claim 22 or 23, wherein the bulking jet ejects fluid at a temperature of approximately 180 to 240° C.

26. The system of claim 24, wherein the outer surface of the bulking drum is perforated to enable cooling air to be drawn through the caterpillar and into the drum.

27. The system of claim 22 or 23, wherein the spray nozzle is further positioned adjacent the bulking jet.

28. The system of claim 22 or 23, wherein the system includes multiple spray nozzles positioned adjacent the bulking device outer surface.

29. The system of claim 22 or 23, further comprising heated draw rolls that raise the temperature of the yarn before it enters the bulking jet.

30. The system of claim 22 or 23, wherein the bulking device is a moving belt.

31. The system of claim 22 or 23, wherein the spray nozzle is configured to spray dye onto the yarn caterpillar.

32. The system of claim 22 or 23, wherein the spray nozzle is configured to spray a dye preventing agent selected from the group consisting of stain resists, colorless base dyes and bleaching agents onto the yarn caterpillar.

33. The method of claim 1, further comprising applying steam to the caterpillar to improve color fixing.

34. The system of claim 22 or 23, further comprising a steam chamber adjacent the bulking device configured to apply steam to the caterpillar steam to improve color fixing.

35. A method for making a mirror imaged dyed synthetic yarn, the method comprising: extruding synthetic polymer into filaments; quenching said filaments in air; bringing the filaments together to form a yarn; bulk texturing said yarn; impinging said yarn into caterpillar form; applying a dye preventing agent selected from the group consisting of stain resists, colorless base dyes and bleaching agents to the yarn while the yarn is in caterpillar form; and optionally subsequently dyeing the yarn.

36. The method of claim 35, wherein applying a dye preventing agent comprises applying said dye preventing agent to the yarn while it rests in caterpillar form on the surface of a rotating drum.

37. The method of claim 35, wherein applying a dye preventing agent comprises applying said dye preventing agent to the yarn while it rests in caterpillar form on the surface of a moving belt.

* * * * *